United States Patent [19]

Ubukata et al.

[11] 4,389,630

[45] Jun. 21, 1983

[54] SNAP ACTION THERMALLY RESPONSIVE SWITCH

[75] Inventors: Susumu Ubukata, 549 Nakasuna-cho, Tenpaku-ku, Nagoya; Yasukazu Mizutani, Nagoya; Syozo Iyada, Nagoya, all of Japan

[73] Assignee: Susumu Ubukatu, Nagoya, Japan

[21] Appl. No.: 241,062

[22] Filed: Mar. 6, 1981

[30] Foreign Application Priority Data

| | | | |
|---|---|---|---|
| Mar. 15, 1980 | [JP] | Japan | 55-32882 |
| Jun. 10, 1980 | [JP] | Japan | 55-78128 |
| Aug. 7, 1980 | [JP] | Japan | 55-108835 |
| Sep. 2, 1980 | [JP] | Japan | 55-122165 |

[51] Int. Cl.[3] ..... H01H 37/54

[52] U.S. Cl. ..... 337/363; 337/89; 337/368

[58] Field of Search ..... 337/45, 46, 53, 57, 337/67, 89, 94, 102, 365, 337, 368, 377, 347, 360, 363

[56] References Cited

U.S. PATENT DOCUMENTS

| | | | |
|---|---|---|---|
| 2,289,095 | 7/1942 | Bletz | 337/368 |
| 2,967,920 | 1/1961 | Harper et al. | 337/89 |
| 3,223,808 | 12/1965 | Wehl | 337/360 |

*Primary Examiner*—William H. Beha, Jr.

*Attorney, Agent, or Firm*—Carroll F. Palmer

[57] ABSTRACT

A thermally responsive switch comprises a housing enclosing a contact arm bearing a fixed contact and a thermally responsive snap-acting element designed to move and return with snap action depending upon the degree of switch self-generated heat or the ambient temperature. One end of the snap-acting element carries a movable contact and its other end is the supporting portion connected to a metallically elastic member mounted in the housing. To a stationary member integrated with the housing, an end support element and a central support element are respectively mounted. The end support element engages the supporting portion of the snap-acting element against the elastically urging force of the elastic member to push in one direction, while the central support element engages a middle portion of the snap-acting element to push in the opposite direction. In this arrangement, the metallically elastic member is urged to engage the end support element elastically intermediate the snap-acting element, and at the same time, urging the snap-acting element in the direction its movable contact travels for opening the contacts. This configuration makes it possible that each of the two support elements engage the snap-acting element with a certain pressure when the thermally snap-acting element respectively moves and returns.

10 Claims, 17 Drawing Figures

SNAP ACTION THERMALLY RESPONSIVE SWITCH

BACKGROUND OF THE INVENTION

1. Field of the Invention

The present invention relates to thermally responsive switches for protecting electric motors against thermal damage by opening an electrical circuit of the motors and, more particularly, to such switches in which the element that actuates a movable contact is thermally responsive and snap-acting to move and return with snap-action depending upon a high or low degree of temperature.

2. Discussion of the Prior Art

Conventionally, a thermally responsive snap-acting element 1 is formed into concave shape having a movable contact at its one end 1*a* and cantilever mounted to a stationary support 2 through the opposite end 1*b* of said end 1*a* as shown in FIG. 1. Or otherwise, in addition to said ends 1*a*, 1*b* the snap-acting element 1 has a central hole 1.5 into which a pin 3 having a lower end stop 4 is loosely inserted with said end 1*b* engaged in a side groove 5 made in a stationary support 6 to allow limited vertical traveling of said element 1 as shown in FIGS. 3 and 4. For the former shown in FIG. 1, with the movable contact 1*a* engaging a fixed contact 7, the contact pressure between the two contacts 1*a*, 7 often fails to be sufficient because buckling frequently occurs in the proximity of the end portion, i.e., the portion 1*c* as shown in FIG. 2, since the snap-acting element 1 is cantilever mounted to the stationary support 2. The term "buckling" in this description means that the portion 1*c* of the snap-acting element 1 is plastically bent by the pressure exerted between the two contacts 1*a* and 7 before snapping to open the contacts 1*a* and 7.

For the latter, with a two-point supporting configuration shown in FIG. 3, the buckling hazard is eliminated. However, a disadvantage is caused from the fact that idling clearances exist longitudinally to the element 1 between the element 1 and supports (generally indicated by the numerals 3 and 6). Accordingly, before snapping, the upper central face of said element 1 contacts the pin 3, while the end 1*b* contacts the lower side 5.1 within the groove 5 as shown in FIG. 3. But when snapped as shown in FIG. 4, the lower central face of the element 1 is forced to move for contacting the stop 4 because of the welding-like force created by arc flame which can prevent the movable contact 1*a* from separating the fixed contact 7, while the end 1*b* travels for contacting the upper side 5.2 within said groove 5. As a result, the movable contact 1*a* approaches the fixed contact 7 by the displacement corresponding to that by which the element 1 lowered. Thus, the required contact-open gap between the contact 1*a* and 7 is partly lost due to the idling clearances existing in the portion at 3 and 5. For example, assuming the snap-acting element 1 is approximately 15 (mm) long, the contact-open gap narrows up to approximately 0.4 (mm) at its moving end since the snap-acting element 1 bends, but does not move the contact until completely snapped. If the tolerance of said idling clearances on the production process is within 0.1 (mm), the contact-open gap at the point of complete snap becomes as narrow as approximately 0.2 (mm) to that of having no clearance so as to become unacceptable as a contact. On the other hand, when the snap-acting element 1 is rigidly fixed to regulate the idling movement both with the end 1*b* rigidly fixed to the stationary support 6 and with the pin 3 tightly press fitted into the hole 1.5, however, such stress is set up in said element 1 as to tend curbing its snap-action movement. Accordingly, without permitting the idling, it is not possible for the snap-acting element 1 to move and return with snap action at the desired temperature.

OBJECTS

It is a first object of the invention to provide supporting means on which a thermally responsive element moves and returns with snap action accurately at specified temperatures.

It is a second object of the invention to provide a thermally responsive switch which provides the desired contact pressure between contacts without creating a buckling hazard in its thermally responsive element.

It is a third object of the invention to provide a unique structure which supports a thermally responsive element at a certain supporting portion with limited movement permitted, but regulating the element at its supporting portion to move freely as the gap between contacts becomes narrow.

It is a fourth object of the invention to provide a thermally responsive switch simple in structure, but designed so that a thermally responsive element is connected to an elastic member, while an end support and a central support are arranged so as to engage against an end portion and a central portion of said element from respectively opposite directions as if to push each of them.

The above and further objects and novel features of the invention will more fully appear from the following description when the same is read in conjunction with the accompanying drawings.

DETAILED DESCRIPTION OF THE PREFERRED EMBODIMENTS

Figure 1:
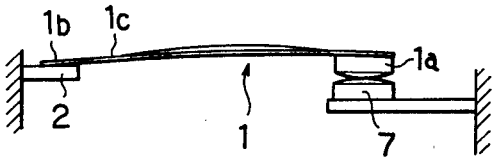
FIG. 1 PRIOR ART
FIG. 1 is a schematic side view showing a prior art "thermally responsive switch" and FIG. 2 is similar to FIG. 1 except for the situation where the thermally responsive element is buckled.
Figure 2:
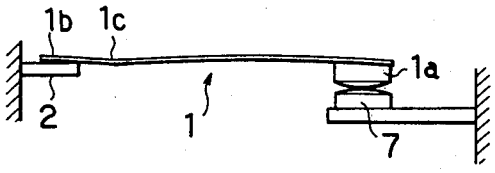
FIG. 2 PRIOR ART
Figure 3:
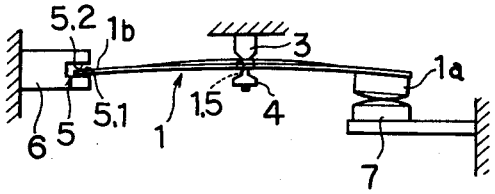
FIG. 3 PRIOR ART
FIG. 3 is a schematic side view showing another prior art "thermally responsive switch" and FIG. 4 is similar to FIG. 3 illustrating a different operation stage from that of FIG. 3.
Figure 4:
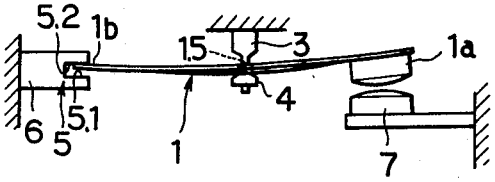
FIG. 4 PRIOR ART
Figure 5:
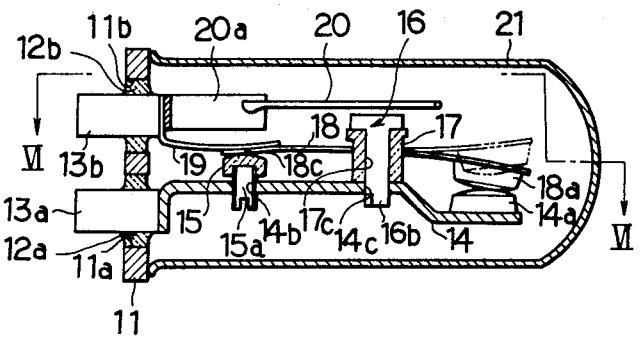
FIG. 5 is a longitudinal cross sectional view illustrating a thermally responsive switch of a first embodiment of the invention.
Figure 6:
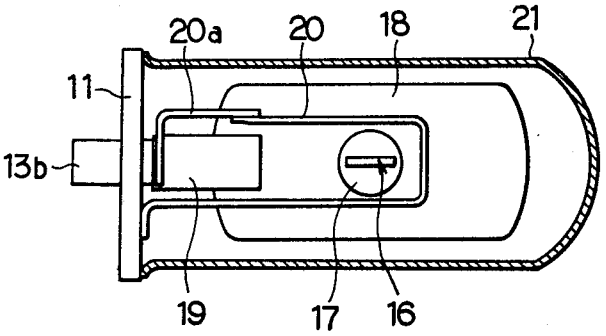
FIG. 6 is a cross sectional view taken on the line VI—VI of FIG. 5.
Figure 7:
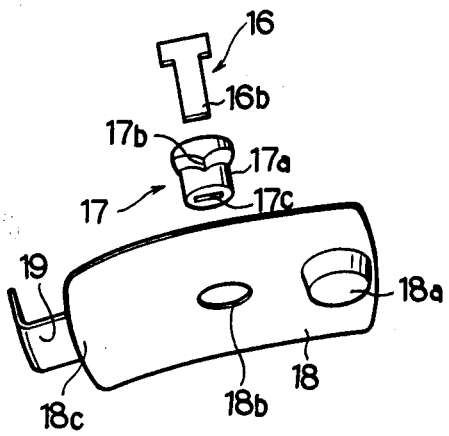
FIG. 7 is an exploded, perspective view of the first embodiment with a congregated assembly of the thermally responsive element and a central support.

Referring to FIGS. 5–8, a header plate 11 is formed into disc-shape having two apertures 11*a*, 11*b*. In each aperture, are terminal pins 13*a*, 13*b* respectively secured in electrically insulated relation to the plate 11 by means of a glass sealant or the like. To the right end of the terminal pin 13*a* is a relatively longer rigid supporting member 14 serving as a contact arm secured by means of welding or the like. Said member 14, in turn, has a fixed contact 14*a* at its right end, a screwed hole 14*b* in which a screwed stud 15*a* is screwed for calibrating the temperature of a snap-acting element and a hole 14*c* into which a central supporting pin 16 is inserted. A thermally responsive element 18 comprised of bimetallic or trimetallic element in the form of a rectangular-like plate having both a movable contact 18*a* and a central concave-shaped area just like a dish as shown in FIG. 7 so that said element 18 moves with snap action from the solid line contacts-closed position to the opposite dashed line contacts-open position on a first predetermined temperature, e.g., 120° C., as illustrated in the solid line seen in FIG. 5. The element 18 has also a central elliptic hole 18*b* into which an elliptically tubular portion 17*a* of a central support 17 is inserted. An elastic member 19 is formed of resiliently metallic plate, e.g., phosphor bronze or steel or the like, the one end of which is anchored on the right end that is, a support end 18*c* by means of welding or the like. The other end of the elastic member 19 is secured to a stationary member, e.g., said terminal pin 13*b* by the same means stated above.

Figure 8:
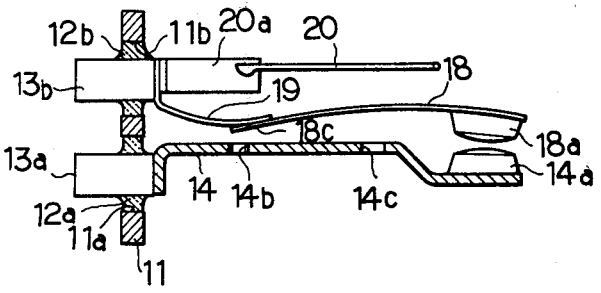
FIG. 8 is a cross sectional view showing the thermally responsive element of the first embodiment at a specified assembly stage.

FIG. 7 shows an assembly stage with the central support 17, the central supporting pin 16 and the screwed stud 15*a* assembled. The elastic member 19 is configurationally designed so that the movable contact 18*a* is spaced relative to the fixed contact 14*a*, and the support end 18*c* is adjacent to the supporting member 14, though the element 18 is convex shaped toward the upper direction as shown in FIG. 8.

The lower end 16*b* of the supporting pin 16 is inserted in the hole 17*c* of the central support 17 and the hole 14*c* is twisted so that said pin 16 is secured in the element 18 against removal with said element 18 pushed downwardly by a downwardly extending edge 17*b* defined in the central support 17. The screwed stud 15*a* serves as a substantial stationary member and is secured into the screwed hole 14*b* so as in the close proximity of a support end 18*c* to push upwardly through the insulating end 15 made of ceramic or the like. Thus, a predetermined contact pressure is exerted between the movable contact 18*a* and the fixed contact 14*a* with a normal ambient temperature as shown in solid line contact-closed position in FIG. 5.

In this situation, even though the elastic member 19 is subjected to local deformation, the restitution force of the elastic member 19 does not deform the curvature shape of the element 18.

The restitution force of the elastic member 19 constantly acts to have the quasi-central portion of the element 18 engage the edge portion 17*b* of the central support 17 and to have the support end 18*c* depress toward the end support 15 for engagement with an equivalent force to the contact pressure created between contacts 18*a* and 14*a*. In other words, the end support 15 engages in the proximity of the support end 18*c* as if to push upwardly so that the movable contact 18*a* tends to separate from the fixed contact 14*a*. While the edge 17*b* of the central support 17 engages the quasi-central portion of the element 18 as if to push in the opposite direction as the end support 15 might push said support end 18*c* so that the movable contact 18*a* tends to contact the fixed contact 14*a*.

The supporting configuration is such that when the element 18 snaps and moves back, the support end 18*c* and the quasi-central portion of said element 18, in turn, engage the end support 15 and the central support 17 allowing themselves slight degrees of freedom to alter their engaging angle, not limiting their complete movement.

If the projecting amount of the end support 15 is raised by turning the screwed stud 15*a* so as to increase the contact pressure between contacts 14*a* and 18*a* for calibrating the actuating temperature of said element 18, the thermally responsive element 18 can be adapted to snap at temperatures lower than 120° C. aforementioned, e.g., 110° C. or 100° C. Adjusting the vertical movement of the end support 15 may be performed by other means than a screw-like member such as said screwed stud 15*a*.

The wire-like member as generally indicated at the numeral 20 in FIGS. 5 and 6 is an auxiliary heating element made from nichrome wire or the like, the one end of which is secured to the terminal pin 13*b* through an angle-shaped support 20*a* by means of welding or the like, and the other end of said member 20 is fastened to the header plate 11 by the same means. The housing 21 is formed into sleeve-shape by drawing, e.g., an iron metal sheet. The left end, i.e., the open end of the housing 21 may be air-tightly secured to the header plate 11 by way of ring projection welding to produce a hermetically sealed vessel.

In the thermally responsive switch comprised in this way, when current flows from the terminal pin 13*a* through the supporting member 14, the fixed contact 14*a*, the movable contact 18*a*, the thermally responsive element 18, the elastic member 19 to the terminal pin 13*b*, and the temperature of said element 18 rises up to, e.g., 120° C., the element 18 snaps to the dashed line contacts-open position as shown in FIG. 5. Since the restitution force of the elastic member 19 acts on the portion where said element 18 engages the end support 15 after snapped to provide a predetermined pressure, the quasi-central portion of said element 18 engages the edge 17*b* of the central support 17 even after being snapped. As a result, even when the contact pressure between contacts 14*a*, 18*a* increases owing to the adjustment of the screwed stud 15*a*, said element 18 remains reluctant to be subjected to buckling in the proximity of the support end 18*c*.

And with the element 18 snapped to the dashed line position as shown in FIG. 5 as well as with said element 18 moved back to the solid line position, the element 18 is regulated to move to narrow the spacing between the movable contact 18*a* and the fixed contact 14*a* and prevents the required contacts-open gap from being closed. This is also understood from the fact that the end support 15 and the central support 17, in turn, engages the support end 18*c* and the quasi-central portion of said element 18 with a predetermined pressure.

Additionally, the thermally responsive element 18 is supported by the end support 15 and the central support 17 with its movement slightly permitted. This makes it possible for the element 18 to initiate its snap-acting movement accurately at a predetermined temperature.

The wire-like member 20 (auxiliary heating element) is for heating the thermally responsive element 18. For example, in cases where the resistant value of the wire-like member 20 is higher than that of said element 18, and when current flows from the terminal pin 13*a* through the supporting member 14, the fixed contact 14*a*, the movable contact 18*a*, said element 18, the elastic member 19, the angle-shaped support 20*a*, the wire-like member 20, the header 11 to the terminal pin 13*b*, the thermally responsive element 18 snaps at 120° C. with relatively smaller current.

The wire-like member 20, however, is not necessarily required for the thermally responsive switch. When it is omitted, the elastic member 19 may be directly secured to the header plate 11 by way of welding or the like eliminating the need of the insulated relationship between the terminal pin 13*b* and the header plate 11. This makes the switch more simple in structure.

Figure 9:
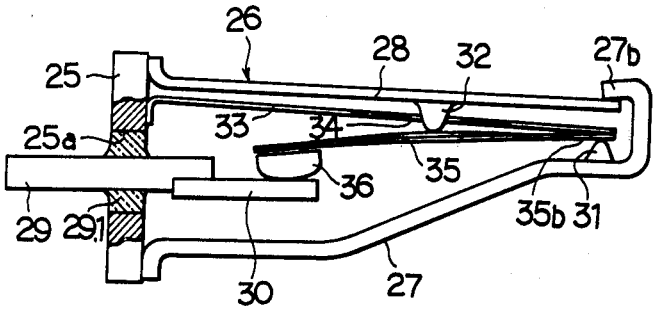
FIG. 9 is a lateral view, partially in section, showing a thermally responsive switch according to a second embodiment of the invention.
Figure 10:
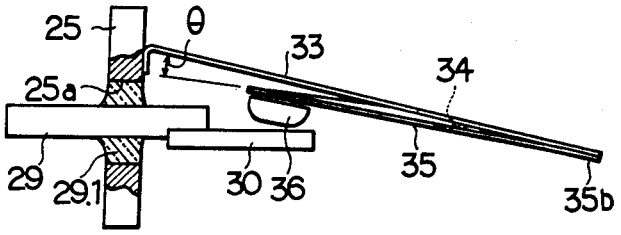
FIG. 10 is a lateral view showing a specified assembly stage in the structure of FIG. 9.
Figure 11:
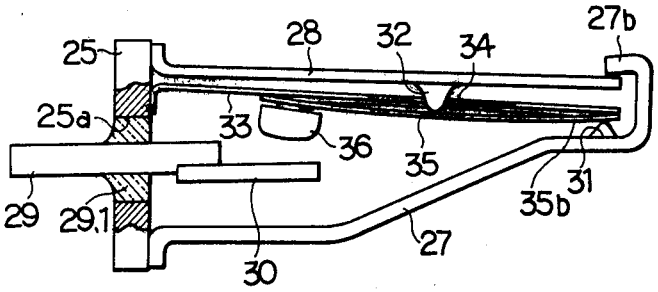
FIG. 11 is a similar view to FIG. 9 with contacts opened.

Referring now to FIGS. 9–11, a thermally responsive switch comprises a header plate 25 made from, e.g., an iron metal sheet, a housing 26 consisting of a double open-sided frame 27 and a lid plate 28. The frame 27 and the lid plate 28 are rigidly secured through their left end to the header plate 25 respectively by means of spot welding or the like. The header plate 25 has a central aperture 25*a* in which a terminal post 29 is secured in electrically insulated relation to said plate 25 by means of a glass sealant 29.1 or the like. To the right end of the terminal post 29 is a fixed contact 30 made of a suitable contact material such as silver metal. The frame 27 gradually rises to form an upward slope from the middle portion toward the right end. On the inner surface of the rised end of the frame 27, a support 31 is mounted. The right end of the frame 27 further extends upwardly to form an inverse L-shaped portion 27*b* to engage the right end of the lid plate 28. To the quasi-central lower surface of the lid plate 28 another support 32 is secured. An elastic strap-like sheet 33 is formed from a phosphor bronze sheet, steel or the like. The left end of the sheet 33 is secured to the header plate 25 by means of welding or the like and the central portion of the sheet 33 has a hole 34 into which the support 32 extends without contacting the opening peripheral portion. Further, to the right end of the elastic strap-like sheet 33, one end of a thermally responsive element 35 is secured which is formed into dish-shaped configuration, e.g., a bimetallic, trimetallic element or the like, to snap from the convex configuration shown in FIG. 9 to the concave configuration shown in FIG. 11 at a first temperature of, e.g., 120° C. and to move back as is shown in FIG. 9 at a second temperature of, e.g., 80° C. In this manner, the elastic strap-like sheet 33 comes into almost parallel registry with the element 35. On the other end of the thermally responsive element 35, a movable contact 36 made of such material as a silver metal or the like is rigidly secured. The elastic strap-like sheet 33 has its right end slopping downwardly to form a narrow angle with said element 35 as shown in FIG. 10. When the frame 27 is rigidly mounted on the header plate 25 at the stage of FIG. 10, the right end of element, 35 i.e., the portion in the close proximity of an end support 35*b* engages the support 31 to be pushed upwardly against the biasing force of the sheet 33 as shown in FIG. 9. On the other hand, when the lid plate 28 is fastened to the header plate 25, the support 32 engages the quasi-central portion of the element 35 through the hole 34 to push downwardly to widen the angle in finishing the assemblage as seen in FIG. 9. The configuration is such that no idling movement of the element 35 occurs in it either at the support 31 or 32 when the element snaps and moves back.

As for the temperature calibration of the snap-acting movement of the element 35, bending over the inverse L-shaped portion 27*b* to push the lid plate 28 downwardly allows for the support 32 to depress the element 35 with increased pressure for intensifying the pressure between the movable contact 36 and the fixed contact 30. So if the element 35 alone snaps at, e.g., 130° C., it can be made to snap at as low as, e.g., 120° C. When the element 35 snaps and moves back, both the end support 35*b* and the quasi-central portion of the element 35, in turn, engages the support 31 and 32. This insures that the required gap between the movable contact 36 and the fixed contact 30 is obtained without sacrificing the transit of the element 35.

The novel and remarkable feature with respect to the second embodiment of the invention is that the end support 35*b* of the element 35 is allowed to rotate within a slight angle with the support 31 as a center in the event of its snap-acting movement. Accordingly the end support 35*b* does not have to be rigidly mounted on the support 31. Preferably the end support 35*b* should come into line-contact with the support 31 for rotation. Since opening of an electric circuit invariably accompanies a welding-like force due to arc flame between contacts, the engaging force of the end support 35*b* against the support 31 must necessarily match the welding-like force in securing a normal snap-acting movement of the element 35.

That the requirement just stated has been satisfied is shown from the observation that there is little difference between the temperature the element 35 is free snapped and that temperature at which the element snaps with its quasi-central portion engaged with the support 32 as seen in FIG. 11.

Figure 12:
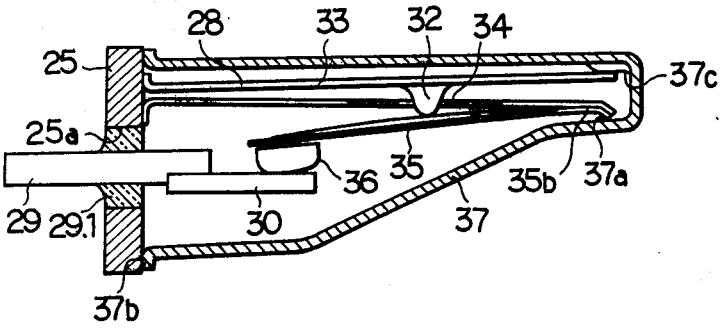
FIG. 12 is a longitudinal cross sectional view showing a thermally responsive switch according to a third embodiment of the invention.

In a third embodiment in which the switch in hermatically sealed, instead of the frame 27, a deep vessel 37 formed by drawing an iron metal sheet or the like forms a housing as seen FIG. 12. To the open end 37*b* of the vessel 37, the header plate 25 is air-tightly secured by means of ring projection welding or the like. The flat ended fulcrum member 37*a* serves as the support 31 which is a part of the inner surface of the vessel 37 itself. By bending over the overlapping portion of the ended support 35*b* and the right end of the sheet 33 together so as to be in contact with the flat ended fulcrum member 37*a*, it becomes easier to enclose the part components into the deep vessel 37 in the assemblage process.

Since the right end of the lid plate 28 contacts the right closed ended portion 37*c* of the vessel 37, pushing the closed ended portion 37*c* downwardly for adjusting the vertical position of the support 32 makes it possible to calibrate the temperature of the snap-acting movement of the element 35 as desired in the same manner mentioned previously.

In both the second and third embodiments of the invention, if the support 31, 32 and the flat ended fulcrum member 37*a* are in electrically insulated relation to the header plate 25, by determining the resistant value from the header plate 25 through the sheet 33, the element 35, the movable and fixed contact 36, 30 to the terminal post 29, it is possible to determine a functional relation between the intensity of current flowing through the switch and the temperature rise of the element 35.

In cases where the support 31, 32 and the flat ended fulcrum member 37*a* are not electrically insulated, the resistant values where each of the three members 31, 32, 37*a* contacts are often indeterminate. This results in the temperature rise of the element 35 being indeterminate because of an uncertain current. However, as long as the temperature rise of the thermally responsive switch is low enough as to be negligible, the switches in regard to the second and third embodiments are fairly acceptable for use at ambient temperature alone.

Figure 13:
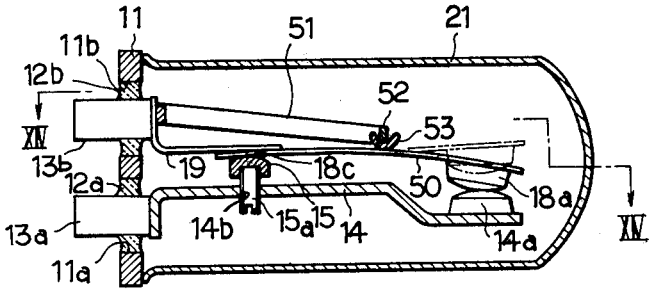
FIG. 13 is a longitudinal cross sectional view showing a thermally responsive switch according to a fourth embodiment of the invention.
Figure 14:
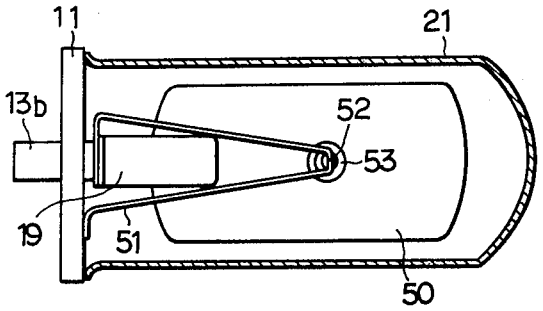
FIG. 14 is a cross sectional view along the line XIV—XIV of FIG. 13.

Now, referring to FIGS. 13 and 14 showing a fourth embodiment of the invention, equivalent elements to those of the first embodiment of FIGS. 5–8 are designated by respective corresponding numerals.

A thermally responsive element 50 comprising a bimetallic, a trimetallic element or the like, is formed as a rectangular-like plate having movable contacts 18*a* and having a central concave shaped area like a dish so that the element 50 snaps and moves back in the same manner as stated in the first embodiment of the invention. A heating element 51 is formed into rigid strap-like shape from a heating material such as nichrome alloy, and then bent into a V-shaped configuration. The heating element 51 is positioned above the thermally responsive element 51 so that one end is secured to the terminal pin 13*b* and the other end is secured to the header plate 11 as seen in FIG. 14. In this arrangement, the heating element 51 is in registry with the upper surface of the element 50. The V-shaped portion 52 of the heating element 51 approaches the quasi-central area of the thermally responsive element 50. To the portion 52 an electrically insulated heat resistant central support 53 is fastened so as to engage the quasi-central portion of the element 50. Thus, the engaging force of the central support 53 against the element 5 counters the pressure from the end support 15 and the fixed contact 14*a*. By turning the screwed stud 15*a*, the first temperature of the snap-acting movement of the element 50 can be calibrated in same manner as described above relative to the first embodiment.

According to the fourth embodiment of the invention, current passes from the terminal pin 13*a* through the supporting member 14, the fixed contact 14*a*, the movable contact 18*a*, the element 50, the elastic member 19 to the terminal pin 13*b*, while current passes from the terminal pin 13*a* to the header plate 11.

In cases where the switch is applied to a thermally protective relay for a split-phase start, single-phase induction motor, current flowing through the main motor winding is adapted to flow from the terminal pin 13*a* to 13*b* and current flowing through the auxiliary motor winding is adapted to flow from the terminal pin 13*a* to the header plate 11. The configuration is such that the current traced from the terminal pin 13*a* to 13*b* mainly contributes to the temperature rise of the thermally responsive element 50 caused from self-heat generation so as to constitute a so-called directly heated type. In cases where excessive current flows through the main winding continuously, depending upon the design, it is possible to shorten the time required from the temperature of the element 50 to reach its first response temperature.

On the other hand, if the current flowing through the auxiliary winding is fractional of that of the main winding in intensity, this hardly contributes to the temperature rise of the element 50 when the current flows through it. But the current flowing through the auxiliary winding also may flow through the heating element 51 and with its high resistance, the heating element 51 generates heat which is transferred to the thermally responsive element 50 so as to constitute a so-called indirectly heated type. Since the auxiliary winding must normally be of high current density, to prevent the heating element 51 from being burning out, it is necessary that the heat generated by the heating element 51 should be transferred to the thermally responsive element promptly.

In the indirectly heated type switch of the prior art, the heat generated by the heating element is transferred to the thermally responsive element through such an amount of space that the time is delayed in raising the temperature of the element high enough for the element to snap. To eliminate the time delay, such measures as to shorten the spacing distance or to enhance wattage of the heating element are taken. However, shortening the distance has its own limit and enhancing the wattage causes deterioration of the heating element.

For example, under such a given condition as the heating element 51 being arranged in the proximity of the thermally responsive element 50 without interfering with the snap-acting movement of the element 50 and with a certain force impressed on the quasi-central portion of the element 50 by other suitable means than the central support 53, it took 9–10 seconds before the switch actuated. When helium gas is used instead of air and other conditions than this were identical, the time required for the switch to actuate was shortened to 6–7 seconds. The thermal conductivity of air is $6\times10^{-5}$ cal/cm.sec.deg. about one-seventh as low as that of helium gas.

According to the invention, switch design is such that the V-shaped top-most portion 52 engages the quasi-central portion of the element 50 through the central support 53 to form solid-to-solid thermally transfer relationship. An extremely high thermal conductivity is obtained compared to through-the-air thermal transfer relationship. As an example, when a high purity aluminous porcelain is employed as a material of the central support 53, since its thermal conductivity is hundreds times as high as that of the air, the time required for the switch to actuate is shortened up to 6–7 seconds under such condition as the central support 53 only locally engages the element 50 as seen in FIG. 13. As a preferred material having higher thermal conductivity, a beryllium procelain is introduced which is about eight times superior to the aluminous procelain in thermal conductivity.

In the embodiment, the central support 53 is an electrically insulated material. This is only because some of the electrical requirements can be canceled. The central support 53 may be an electrically conductive material instead of an insulating substance. Accordingly, when the heating element 51 is arranged for the V-shaped portion 52 directly engages the quasi-central portion of the element 50, the current flowing from about the right half portion of the element 50 will shunt to the rest half of that and the heating element 51 on its way from the terminal pin 13*a* to 13*b*. On the other hand, the current flowing from about the right half of the element 50 will pass the quasi-half portion of the heating element 51 on its way from the terminal pin 13*a* to the header plate 11. By taking resistances of these current pathways into consideration, it might readily be left to the designer to determine the heat requirements. The heating element 51 is metal-to-metal contact against the thermally responsive element 50 so that the thermal exchange relationship between the elements 50, 51 is significantly improved. In the embodiments where the supporting member 14 is secured to the terminal pin 13*a*, each end of the elastic member 19 and the heating element 51 was secured to the terminal pin 13*b*, respectively, and the other end of the heating element 51 was secured to the header plate 11. This invention, however is not confined to the embodiment stated above; some modifications can be made. For example, the supporting member 14 may be attached to the header plate 11, one end of the elastic member 19 and the heating element 51 may be fixed to the terminal pin 14*a*, respectively, and the other end of the heating element 51 may be secured to the terminal pin 13*b*. Accordingly, the three members, i.e., the header plate 11, the terminal pins 13*a* and 13*b*, can be treated as three poles electrically insulated respectively. Accordingly, each pole has the same function in constituting the thermally responsive switch.

A fifth embodiment of the invention provides a thermally responsive switch well-suited for three-phase thermal protection coupled with low cost. In this, the number of contacts required is reduced to only two couples with a movable and fixed contact as a couple, and a thermally responsive element formed into concave shape is supported by an after mentioned means so as to open the plurality of contacts almost simultaneously.

Furthermore, by arranging a supporting member of a fixed contact distant from a central portion of a thermally responsive element, it makes it possible to avoid thermal damage and provide life long.

In opposition to that, conventionally in prior art types of three-phase thermal protector, no less than three couples of expensive contacts are required and besides that a thermally responsive element is supported by a supporting member such as a screw stud or the like. These facts inevitably lead to increase of both manufacturing and material costs.

Figure 15:
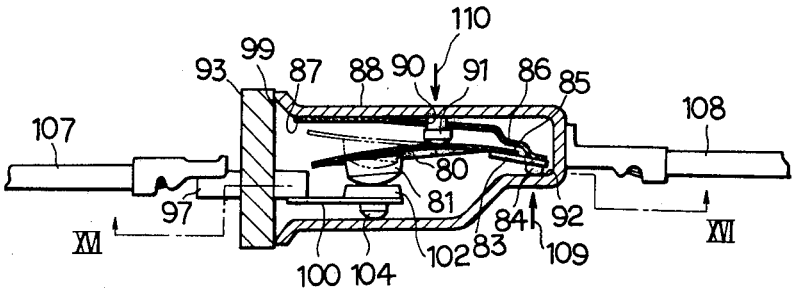
FIG. 15 is a longitudinal cross sectional view showing a thermally responsive switch according to a fifth embodiment of the invention.
Figure 16:
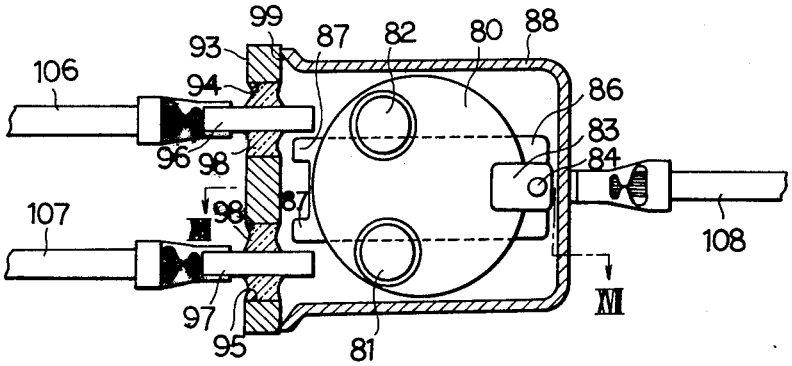
FIG. 16 is a cross sectional view along the line XVI—XVI of FIG. 15.
Figure 17:
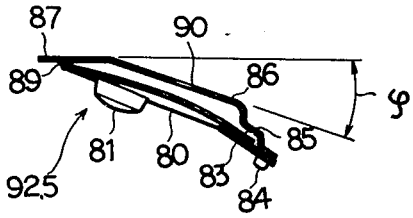
FIG. 17 is a partial sectional view showing a specified assembly stage of a thermally responsive switch along the line XVII—XVII of FIG. 16.

In reference to FIGS. 15–17, there is illustrated a thermally responsive element, generally designated at 80, which is formed into a circularly dish-shaped configuration having two movable contacts 81, 82 fixed so that the element 80 snaps from the solid line contacts-closed position to the dotted line contacts-open position seen in FIG. 15 when the temperature reaches to a first temperature, e.g., 110° C. from a second temperature, e.g., 70° C. A connecting tongue 83 formed of an iron metal sheet or the like, is rigidly secured at one end to a support end 85 of the element 80 so as to define a three-point support configuration in cooperation with the movable contacts 80 and 81 by means of welding or the like. The other end of the tongue 83 is secured to the right end of an electrically conductive sheet 86 by the same means stated above. The configuration is such that the conductive sheet 86 almost comes into parallel registry with the element 80. The conductive sheet 86 is formed of a thin metallic sheet to serve as an elastic means so that the sheet is flexible in the vertical direction but is of high rigidity in the horizontal direction, and a ceramic protrusion 84 is anchored to the right end of the connecting tongue 83. Furthermore, from the left end of the conductive sheet 86, a protuberance 87 integrally extends and is fixed to the inner surface of a switch case 88 by means of welding or the like.

In the embodiment just the above, the conductive sheet 86 is secured to the element 80 through the connecting tongue 83. However, this connecting tongue 83 may be omitted from the functional view-point.

With reference to FIG. 17, there is illustrated a free configuration with the conductive sheet 83. As is seen in FIG. 17, both right and left ends of the sheet 86 are previously bent so that the sheet 86 slopes in the proximity of the protuberance 87 at an angle to the horizontal plane with a minimum gap 89 left between the element 80 and the protuberance 87.

Now, between the upper surface of the switch case 88 and the element 80, a stud-like ceramic central support 91 is adapted to be intermediate through a hole 90 bored in the sheet 86.

Moreover, the bottom portion abutting on the closed end of the switch case 88 is defined to position higher level than the rest of the bottom area so as to serve as an end support 92. Accordingly, when a unit 92.5 comprising the sheet 86 and the element 80 shown in FIG. 17 is incorporated into the switch case 88, the ceramic protrusion 84 engages the end support 92 with a certain pressure, while the central support 91 extends through the hole 90 to be in press contact with the quasi-central portion of the element 80.

The ceramic central support 91 engages the element 80 in such a manner that the engaging force is shared by three members, that is, the two movable contacts 81, 82 and ceramic protrusion 84, almost equally. In the event where the element 80 snaps and moves back, the quasi-central portion of the element 80 engages the central support 91, while the protrusion 84 also engages the end support 92 of the switch case 88. A lid plate 93 formed from, e.g., iron metal, has two apertures 94, 95 and two terminal posts 96, 97 secured air-tightly in the apertures 94, 95 respectively in electrically insulated relation to the plate 93 by means of a sealant material 98. The lid plate 93 is secured to the left open end 99 of the switch case 88. If desired, the switch might be readily formed into a hermetically sealed vessel. To each of the terminal posts 96, 97 are contact arms 100 and 101 (not shown) having fixed contacts 102 and 103 (not shown) secured in registry with the movable contacts 81 and 82 respectively. In this situation, the element 80 is in registry with the contact arms 100, 101 only through each one of their extremity so that the contact arms 100, 101 may be as distant from the element 80 as possible. In cases where the engaging force of the fixed contacts 102, 103 against the movable contacts 81, 82 are insufficient, ceramic spacers 104 and 105 (not shown) may be interposed between the switch case 88 and the contact arms 100 (and/or 101) for making up the force. Lead wires 106, 107 are physically connected to the terminal posts 96, 97 respectively and other lead wire 108 is physically connected to the switch case 88.

On applying the switch to a three-phase induction motor as a thermal protector, each of the lead wires 106, 107, 108 is physically connected to the neutral point of the Y-connected winding of the motor. When the motor is energized, current passes from the lead wire 107 through the terminal post 97, the contact arm 100, the fixed contact 102, the movable contact 81, the element 80, the movable contact 82, the fixed contact 103, the contact arm 101, the terminal post 96 to the lead wire 106. On the other hand, current passes from the lead wire 107 through the terminal post 97, the contact arm 100, the fixed contact 102, the movable contact 82, the element 80, the tongue 83, the conductive sheet 86, the switch case 88 to the lead wire 108. Then current pathway from the lead wire 106 to 108 is treated in the same manner as that between the lead wire 107 and 108.

From the stand point of securely protecting the three phase induction motor against open-phase, overcurrent and overload, it is necessary that the switch must actuate when the overcurrent flows between the lead wires 106, 107 under the same required time as when it flows between the lead wires 107, 108 (or between the lead wires 106, 108) and intensity of an ultimate temperature current must be almost equal in regard to each current pathway leading to the electrical neutral point of the element 80. Suffice to say to meet the above requirement that the resistant value between the movable contact 8 (or 80) to the connecting tongue 83 and the heat generated by the resistance from the post 97 (or 96) to the fixed contact 102 (or 101) must influence as the same extent upon the element 80 as that generated by the resistance from the tongue 83 to the switch case 88. In the embodiment of the invention, especially because of the relatively easy alteration of the contact arm 100 (or 101) and the conductive sheet 86 in their resistant value, adjusting the resistant value of each member as described above makes it possible to meet the requirement.

Furthermore in each snap-acting movement of prior known thermally responsive elements, an arc occurs between the element and the contact arms. This arc is likely to last owing the fact that any one phase-voltage of the three-phase A.C. power source is constantly present in opposition to the case of a single-phase power. According to the experience, if each of the contact arms are in registry with the element, the arc is likely to pass across the central portion of the element and the contact arms, resulting in giving thermal damage to the element so that the actuating temperature likely changes from the initially predetermined value. In contrast to that, pursuant to the fifth embodiment, the contact arms 100, 101 are positioned distant from the central portion of the element 80. The central portion of the element 80 is not likely to be exposed to arc flame and hardly subjected to a thermal damage hazard, thus results in the life being long.

Still further, in calibrating the first temperature with respect to the element 80, by squelching portions generally designated at 109, 110 of the switch case 88 in arrowed directions respectively, the temperature can be adjusted to approach toward the second temperature and this results in eliminating the need of specific means such as a screw or the like to provide a simple and easily-calibrated switch.

This invention includes all modifications and equivalents of the illustrated embodiments of the invention which fall within the purview of the appended claims.

What is claimed is:

1. A snap-action thermally responsive switch that comprises:

a multi-metallic thermally responsive strip element including a first end, an opposite second end, a central portion integral with said first and second ends, an upper surface and a lower surface, a moveable contact fixed to said lower surface at said first end, a fixed contact secured to a stationary member for engagement and disengagement with said moveable contact, an elastic member upon which said second end of said strip member is supported, a first support member that osculates said second end of said strip member and exerts thereon a biasing force against said lower surface, a second support member that osculates said central portion of said strip member and exerts a biasing force against said upper surface of said strip member, said strip member being unfixed to said first and second support members permitting relative movement therebetween when said strip member undergoes snap-action.

2. A thermally responsive switch as set forth in claim 1 wherein said fixed contact is secured to a contact arm to which said first support member and second support member are respectively secured in electrically insulated relation to said contact arm.

3. A thermally responsive switch as set forth in claim 2 wherein said first support member includes screw means which by which to adjust its protruding amount from said contact arm.

4. A thermally responsive switch as set forth in claim 1 wherein one end of said elastic member is fixed to a stationary member and the other end is fixed to said second end of said strip element so that said elastic member is in almost parallel registry with said strip element.

5. A thermally responsive switch as set forth in claim 1 wherein said strip element and said elastic member are received in a housing on which said first and second support members are mounted and said second support member engages said strip element through a hole made in said elastic member.

6. A thermally responsive switch as set forth in claim 1 wherein heating means is secured to a stationary member to project therefrom in registry with said strip element to heat said strip element through space, and the projected end portion of such heating means engages said central portion of said strip element so as to serve as said second support member.

7. A thermally responsive switch as set forth in claim 6 wherein said projected end portion engages said thermally responsive element through electrically insulated material.

8. A thermally responsive switch as set forth in claim 1 wherein said strip element is formed into a dish-shaped configuration having two movable contacts electrically conductively secured thereto and one end of said elastic member is secured to said second end of said strip element to form a three-point support configuration cooperating with said two movable contacts and the other end of the elastic member is electrically conductively secured to a switch case so that said elastic member itself is in almost parallel registry with said strip element.

9. A snap-action thermally responsive switch that comprises:

a multi-metallic thermally responsive strip element formed into a dish-shaped configuration including a first end, an opposite second end, a central portion integral with said first and second ends, an upper surface and a lower surface, a pair of moveable contacts fixed to said lower surface at said first end, a pair of fixed contacts secured to stationary members for engagement and disengagement with said moveable contacts, an elastic member upon one end of which said second end of said strip member is supported and the other end of the elastic member is electrically conductively secured to a switch case so the said elastic member itself is in almost parallel registry with said strip element.

a first support member that osculates said second end of said strip member and exerts thereon a biasing force against said lower surface, a second support member that osculates said central portion of said strip member and exerts a biasing force against said upper surface of said strip member, said strip member being unfixed to said first and second support members permitting relative movement therebetween when said strip member undergoes snap-action.

10. The thermally responsive switch of claim 9 wherein said first support member is a ledge portion in said switch case.

* * * * *